US006443405B1

(12) United States Patent
Han

(10) Patent No.: US 6,443,405 B1
(45) Date of Patent: Sep. 3, 2002

(54) GOLF BAG WITH SEATING APPARATUS

(76) Inventor: Don Kyu Han, 1 Saros, Irvine, CA (US) 92812

( * ) Notice: Subject to any disclaimer, the term of this patent is extended or adjusted under 35 U.S.C. 154(b) by 0 days.

(21) Appl. No.: 09/288,910

(22) Filed: Apr. 9, 1999

(51) Int. Cl.[7] ..... A63B 55/00
(52) U.S. Cl. ..... 248/96; 206/315.7; 280/646
(58) Field of Search ..... 248/96, 95, 97; 206/315.3, 315.7, 315.8; 280/645, 646, 652, 47.25; 297/217.1, 255; 224/918, 917, 274

(56) References Cited

U.S. PATENT DOCUMENTS

| | | | | | |
|---|---|---|---|---|---|
| 1,757,471 | A | | 5/1930 | Platt | |
| 2,430,107 | A | | 11/1947 | Cronrath | |
| 3,735,997 | A | * | 5/1973 | Seibold et al. | 280/36 |
| 3,995,881 | A | * | 12/1976 | Kruchell | 280/646 |
| 4,062,564 | A | * | 12/1977 | Schimmeyer | 280/652 |
| 4,098,478 | A | * | 7/1978 | Spitzke | 248/156 |
| 4,400,006 | A | * | 8/1983 | Larkin | 280/646 |
| 4,403,806 | A | * | 9/1983 | Stephen | 297/217 |
| 4,431,230 | A | * | 2/1984 | Sutton | 297/217 |
| 4,620,682 | A | | 11/1986 | Yim | 248/96 |
| 4,834,235 | A | | 5/1989 | Solheim et al. | 206/315.7 |
| 4,921,192 | A | | 5/1990 | Jones | 248/96 |
| 4,988,117 | A | * | 1/1991 | Shortall | 280/646 |
| 5,152,483 | A | | 10/1992 | Maeng | 248/96 |
| 5,154,377 | A | | 10/1992 | Suk | 248/96 |
| 5,186,424 | A | | 2/1993 | Shultz et al. | 248/179 |
| 5,209,350 | A | | 5/1993 | Maeng | 206/315.7 |
| 5,236,085 | A | * | 8/1993 | Quellais | 248/96 X |
| 5,340,063 | A | | 8/1994 | Hsieh | 248/96 |
| 5,415,285 | A | | 5/1995 | Reimers | 206/315.7 |
| 5,439,241 | A | * | 8/1995 | Nelson | 280/645 |
| 5,464,180 | A | | 11/1995 | Cheng | 248/96 |
| 5,505,471 | A | * | 4/1996 | Cheng | 280/646 |
| 5,507,384 | A | | 4/1996 | Maeng | 206/315.7 |
| 5,516,064 | A | | 5/1996 | Hsieh | 248/96 |
| 5,549,263 | A | | 8/1996 | Maeng | 248/96 |
| 5,607,128 | A | | 3/1997 | Suk | 248/96 |
| 5,762,189 | A | | 6/1998 | Reimers | 206/315.7 |
| 5,799,786 | A | | 9/1998 | Beck et al. | 206/315.7 |
| 5,836,601 | A | * | 11/1998 | Nelson | 280/645 |
| 6,062,383 | A | * | 5/2000 | Han | 206/315.7 |

* cited by examiner

*Primary Examiner*—Ramon O. Ramirez
*Assistant Examiner*—Tan Le
(74) *Attorney, Agent, or Firm*—Lee & Hong

(57) ABSTRACT

A golf bag having a body and support stand pivotally attached to the body and a seat member extending from the body. When the bag is tilted on a supporting surface, the leg or legs of the stand pivot away from the bag body to form a support for the bag as it rests on the supporting surface. The seat protrudes from the side of the bag opposite the stand the seating surface substantially parallel to the supporting surface. The seating surface is supported by a substantially rigid member of sufficient strength to support a golfer.

25 Claims, 10 Drawing Sheets

GOLF BAG WITH SEATING APPARATUS

BACKGROUND OF THE INVENTION

1. Field of the Invention

This invention relates to golf bags, and more particularly to golf bags with extendable and retractable support stands and fixed and removable seating surfaces.

2. Description of Related Art

Golf is one of the most widely played sports activities in the United States. Not only is this activity already widespread, but the number of golfers continue to grow due to popularity of the sport caused by high stake televised games.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference") incorporated herein by reference. In the Suk reference, before a pair of legs can be used to support a golf bag, a slide member must be moved in a descending position along a two parallel groove track formed in a slide bracket. When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference") the contents of which are incorporated herein by reference. In the Maeng reference, the pair of legs extend away from the golf bag to provide support when the golf bag is forcefully tilted with respect to the ground. In such a position, the contact surface area of the golf bag with the ground is minimal, which comprises the tips of two legs and an edge of the golf bag, and thus possibly causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

Application 09/218,993 filed Dec. 22, 1998, the contents of which are incorporated herein by reference, includes an actuator disposed inside of the body of the golf bag that actuates the leg movements.

Since golf entails periods of waiting and substantial amount of walking during the game, it is also desirable to provide a seat on the golf bag of sufficient strength to support the golfer. The seat should take up a minimal amount of space or be collapsible or removable so as not to impede the golfer in carrying the bag. Where the golfer uses a cart, it is desirable to remove the seat altogether from the bag.

SUMMARY OF THE DISCLOSURE

It is an object of the present invention to provide a self-supporting golf bag having a seat of sufficient strength and dimension to support a golfer when seated thereon that obviates one or more problems of the prior art.

It is a further object of the present invention to provide a golf bag having a collapsible seat that may be collapsed close to the bag for easy transport.

It is a further object of the present invention to provide a removable seat so that golfers using a cart, etc. may use the bag without the seat attached.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

According to a first embodiment of the present invention, a golf bag has a body having a front surface, a back surface, a lower region and a bottom end. The body defines a longitudinal axis. The golf bag further has at least one leg and preferably two legs pivotally connected to the back surface of the body that are able to pivot between a retracted position where the legs are disposed substantially longitudinally along the back surface of the body and an extended position where lower ends of the legs are spaced apart from the body. The golf bag further includes a seat member coupled to the lower region of the front surface of the bag body. The seat member has a seating surface associated with the front surface of the lower region of the bag. This seating surface lies substantially parallel to a supporting surface on which the bag and the lower ends of the legs rest when the bag is in an extended position. The seat also includes a rigid support member that has a top end, a bottom end and a back surface. The top end is perpendicularly coupled to the seating surface and the bottom end rests on the supporting surface when the bag is in an extended position. The back surface is coupled to the bag body.

According to a second embodiment of the present invention, the seat member is removably coupled to the lower region of the bag, the bag having its own base.

According to a third embodiment of the present invention, a golf bag has a body with a front surface, a back surface, a lower region and a bottom end. The body defines a longitudinal axis. The bag further includes two legs pivotally connected to the back surface of the body as described previously herein. The bag also includes a seat member coupled to the lower region of the front surface of the bag body. The seat member has an extendable seating surface associated with the front surface of the lower region of the bag, which lies substantially parallel to a supporting surface on which the bag and the lower ends of the legs rest when the bag is in an extended position. The seating surface lies substantially collapsed against the front surface of the lower region of the bag when the seating surface is in a collapsed (carrying) position. The seating surface has a front end and a back end, the back end associated with the front surface of the lower region of the bag. The seat member also includes a rigid support member that has a crossbar coupled to the front end of the seating surface. The crossbar is connected to each end of a first sidebar and a second sidebar. The two bottom ends of the side bars are pivotally coupled to the bottom end of the front surface of bag body.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 2A:
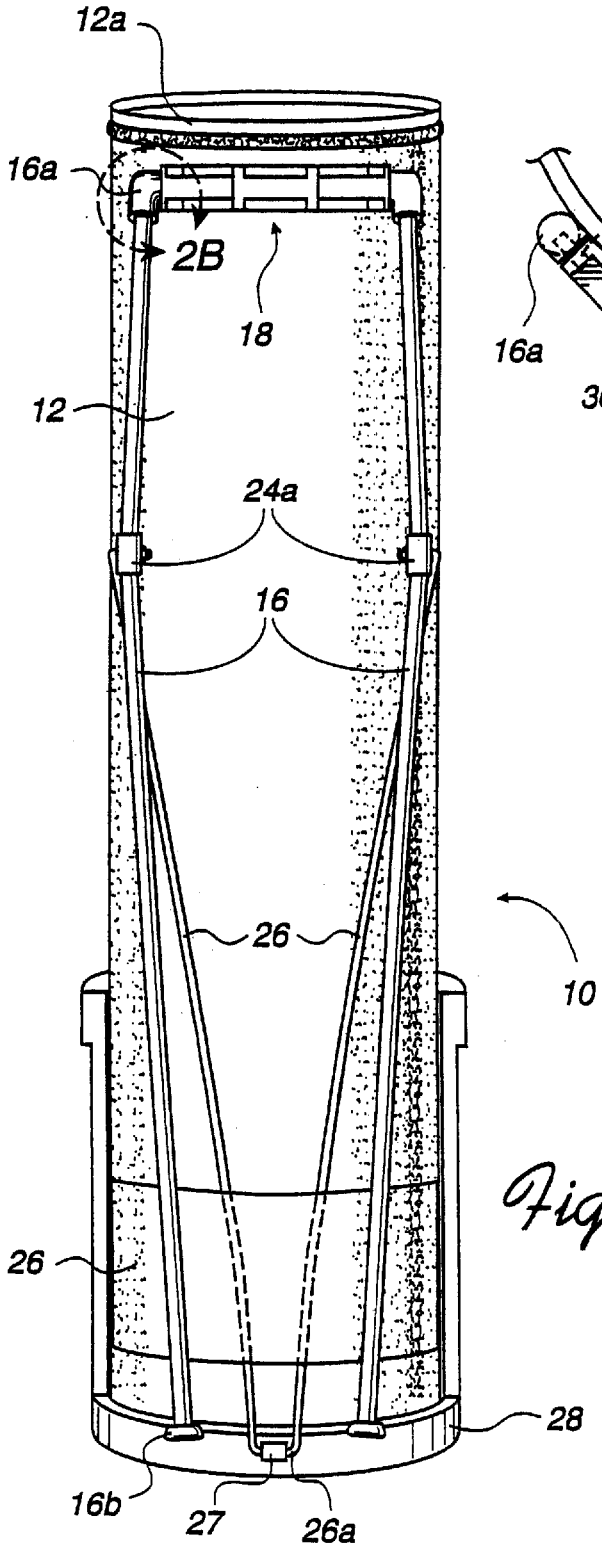
FIG. 2A is a rear view of the embodiment of FIG. 1.
Figure 2C:
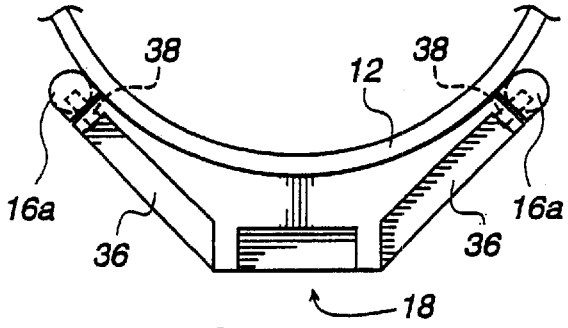
FIG. 2C is a top partial view of the embodiment of FIG. 1.
Figure 2B:
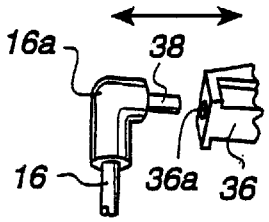
FIG. 2B is an exploded view of a detail of the embodiment of FIG. 1.
Figure 3:
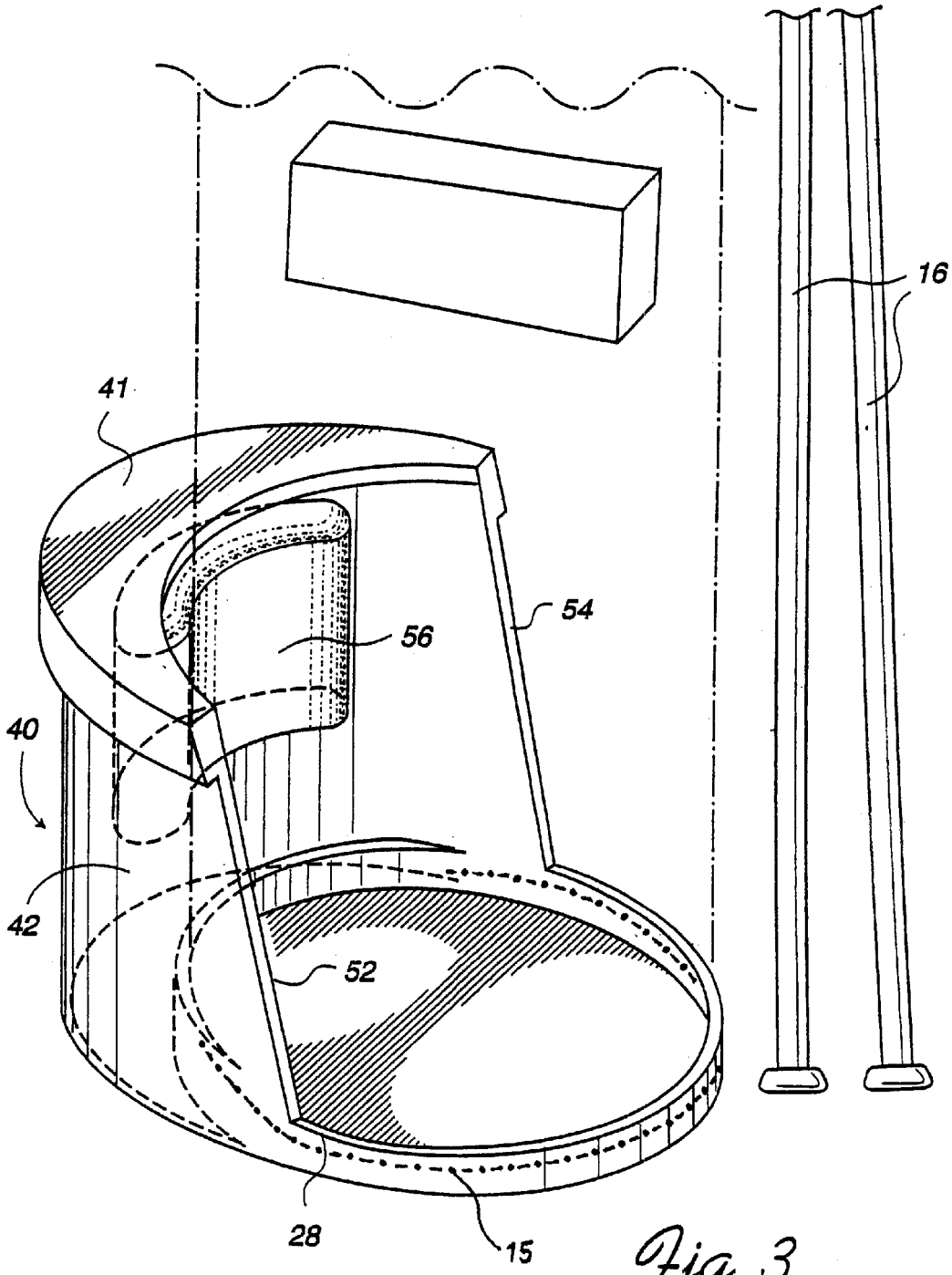
FIG. 3 is perspective partial view of the embodiment of FIG. 1.
Figure 4:
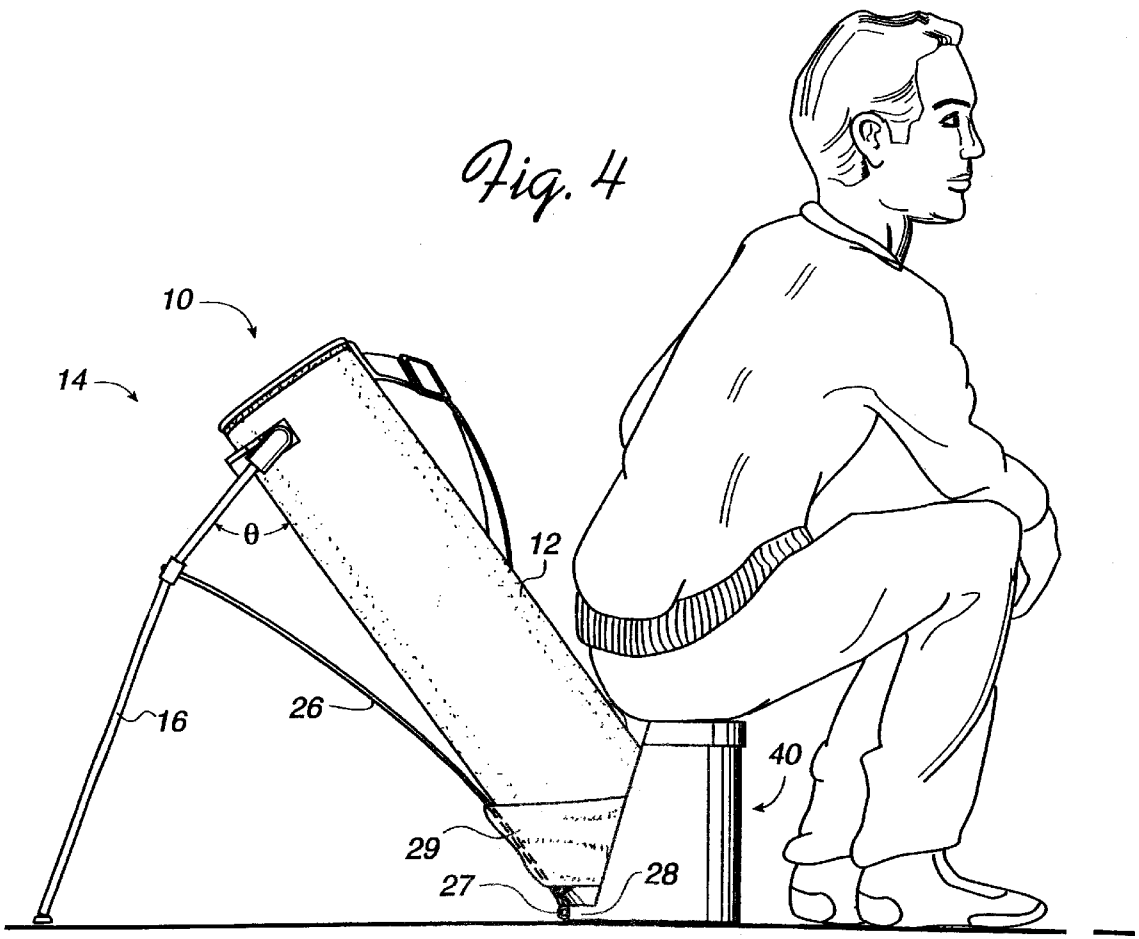
FIG. 4 is a lateral view of the embodiment of FIG. 1 in an extended or leaning position showing use of the seat.
Figure 5:
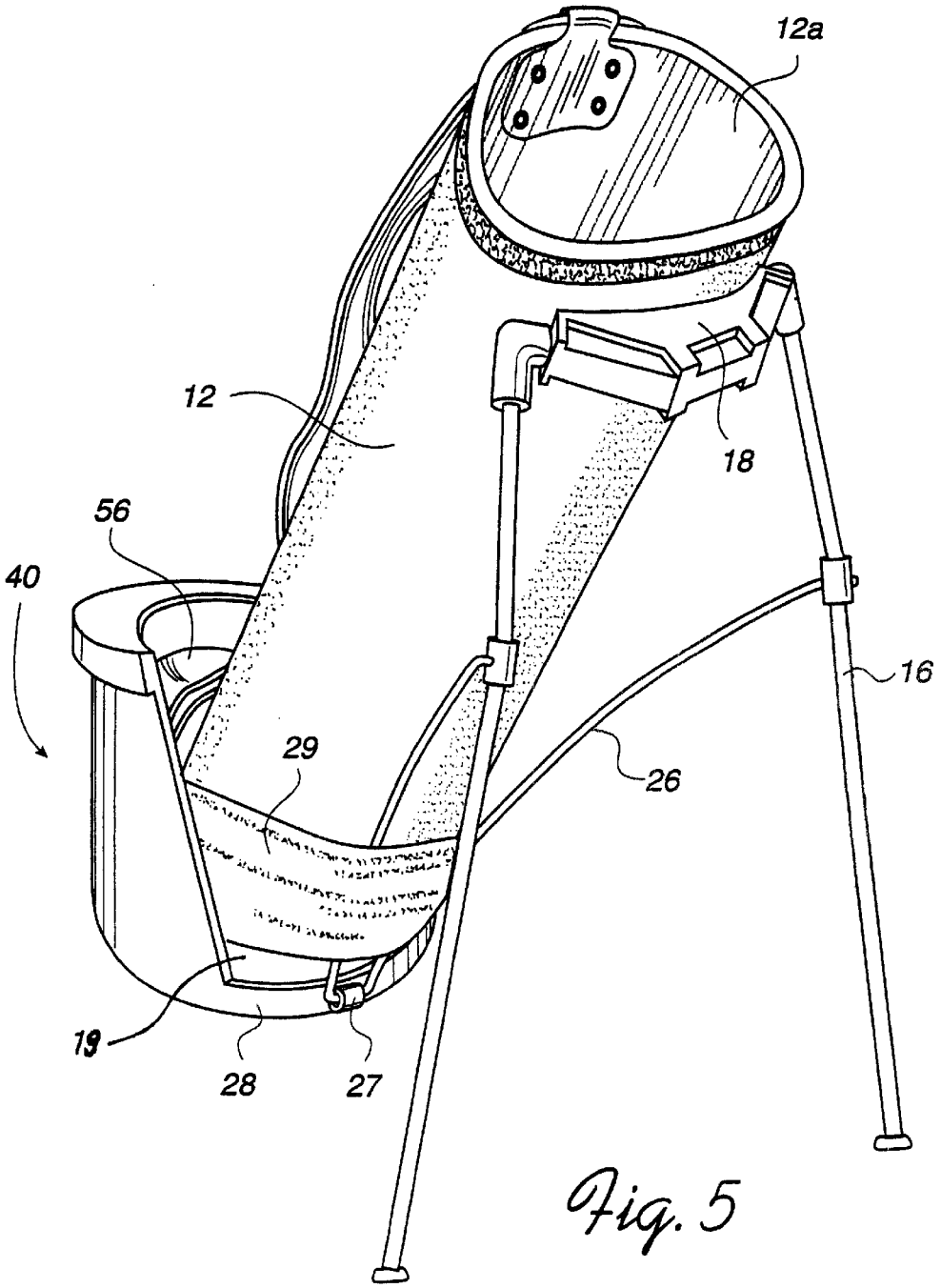
FIG. 5 is a rear perspective view showing the embodiment of FIG. 1.

A golf bag with a support stand and a seat according to embodiments of the present invention is shown in the drawings for purposes of illustration. Referring to FIGS. 1–5, there is shown a golf bag 10 of a first embodiment having a bag body 12, a support stand assembly 14, and a seat member 40. The bag body 12 is preferably tubular in shape and has an opening 12*a* at the top, as best seen in FIG. 5. The bottom of the bag is closed. A rigid base member 28 as best seen in FIG. 3 forms part of a seat member 40. The base member 28 is coupled to the lower portions of the bag body 12 and preferably has a shape similar to a lateral cross-section of the bag body 12.

Figure 1:
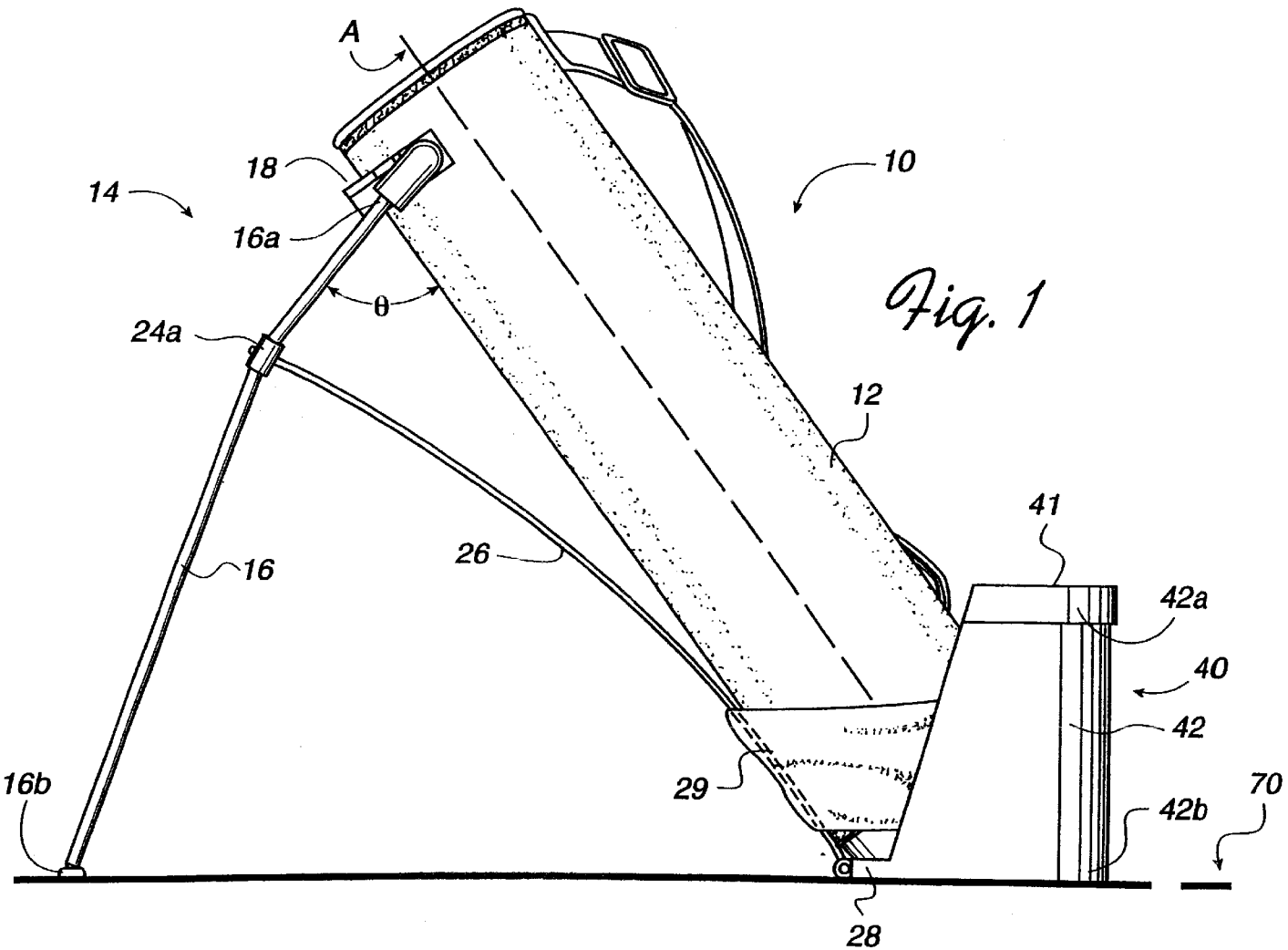
FIG. 1 is a lateral view of a golf bag with a seat member and a support stand assembly according to a first embodiment of the present invention.

First, the support stand assembly will be described. The support stand assembly 14 includes two legs 16, the upper ends 16*a,* of which are pivotally attached to an attachment assembly 18, which is in turn fixed to the bag body 12, preferably near the opening 12*a* of the bag body 12. The bottom ends of the legs 16*b* rest on a support surface when the bag is in an extended position as shown in FIG. 1. In preferred embodiments, each of the legs 16, has a tubular member 24*a* mounted on a middle portion of each leg 16. A linking member 26, such as flexible rod is pivotally connected to each tubular member 24*a* at first end. The second end of each linking member 26 is held against the bag body 12. In the embodiment of FIGS. 1–5, the linking members are held by a support strap 29 as best seen in FIG. 2A. In this embodiment, the second ends of each linking member connect at a cross-member 26*a* as best seen in FIG. 2A. The cross member 26*a* is pivotally coupled to the base member 28, where the cross-member passes through a loop 27 fixed to the base member 28. The legs 16 may pivot between a retracted position and an extended position.

In the retracted position, as shown in FIG. 2A, the entire leg 16 rests along the bag body 12 near an outer surface thereof. In the extended position, as shown in FIGS. 1, 4 and 5, the legs 16 are positioned at an angle θ, preferably between about 20–50 degrees, with respect to a longitudinal axis A of the bag body 12, and the lower ends 16*b* of the legs are spaced apart from the bag body 12. When in the extended position, the lower ends 16*b* of the legs and the base member of the seat may contact a supporting surface 70, such as the ground, so that the golf bag stands on the ground in a self-supported and leaning manner.

The pivoting of the legs 16 between the retracted and extended positions is actuated by pushing downward on the bag preferably at a region where the opening 12*a* is nearest the attachment assembly. When pushed downward or tilted forward, the linking members 26 are caused to flex and pivot away from the bag body thereby moving the tubular members 24*a* away from the bag body 12. Thus the legs 16 are caused to pivot to their extended position. The legs 16 may also be grasped and pulled away from the bag body to their extended position.

The attachment assembly 18 is described in more detail with reference to FIGS. 2A, 2B and 2C. The attachment assembly 18 has two ends 36, each end having a receiving cavity 36*a* open to the exterior. The upper end 16*a* of each leg 16 is an L-shaped member having two ends, a first end coupled to the leg 16 and a second end having a short cylindrical shaft 38 protruding from the second end. The receiving cavity 36*a* of the attachment assembly 18, slidably receives the cylindrical shaft 38 of the L-shaped member, so that the L-shaped member can pivot about the longitudinal axis of the short shaft 38, thus allowing the legs 16 rotate about the longitudinal axis as well.

It will be recognized that other forms of support stands will also function to support the golf bag at an angle when the seat is in use. Moreover, the bag body 12 is made of flexible but resilient material to allow pivoting of the bag while allowing the base member 28 to be placed flush against the support surface 70.

Next, the seat member 40 according to the present invention will be described. FIGS. 1–5 show the first embodiment of the seat member 40 having a seating surface 41 associated with the front surface 17 of the lower region 19 of the bag body 12 and a rigid support member 42 supporting the seating surface. The seating surface 41 lies substantially parallel to a supporting surface 70 on which the base member 28 and the lower ends 16*b* of the legs rest when the bag is in an extended position. The rigid support member 42 preferably has a top end 42*a* and a bottom end 42*b*. The top end 42*a* is perpendicularly coupled to the seating surface 41 and the bottom end 42*b* forms part of the base member 28 and rests on the supporting surface 70 when the bag is in an extended position. The back surface of the seat member 40 is coupled to the bag body 12. In the first embodiment, the seat member 40 includes a rigid base member 28 integrally coupled to the bottom end 42*b* of the supporting structure. The base member 28 surrounds and receives the bottom end 15 of the bag body and is coupled thereto. The seat member is made of a rigid material, such as plastic, and manufactured by a suitable process, such as injection molding, that will render a shape substantially similar to that shown in the drawings.

The support member 42 has a shape of a half-cylinder and includes side walls 52 and 54 which are preferably sloped from top to bottom to support the weight of a golfer. In the first embodiment, there is a pocket 56 disposed in a space defined by the seat member 40 for storing golf accessories, such as balls or shoes.

Figure 6:
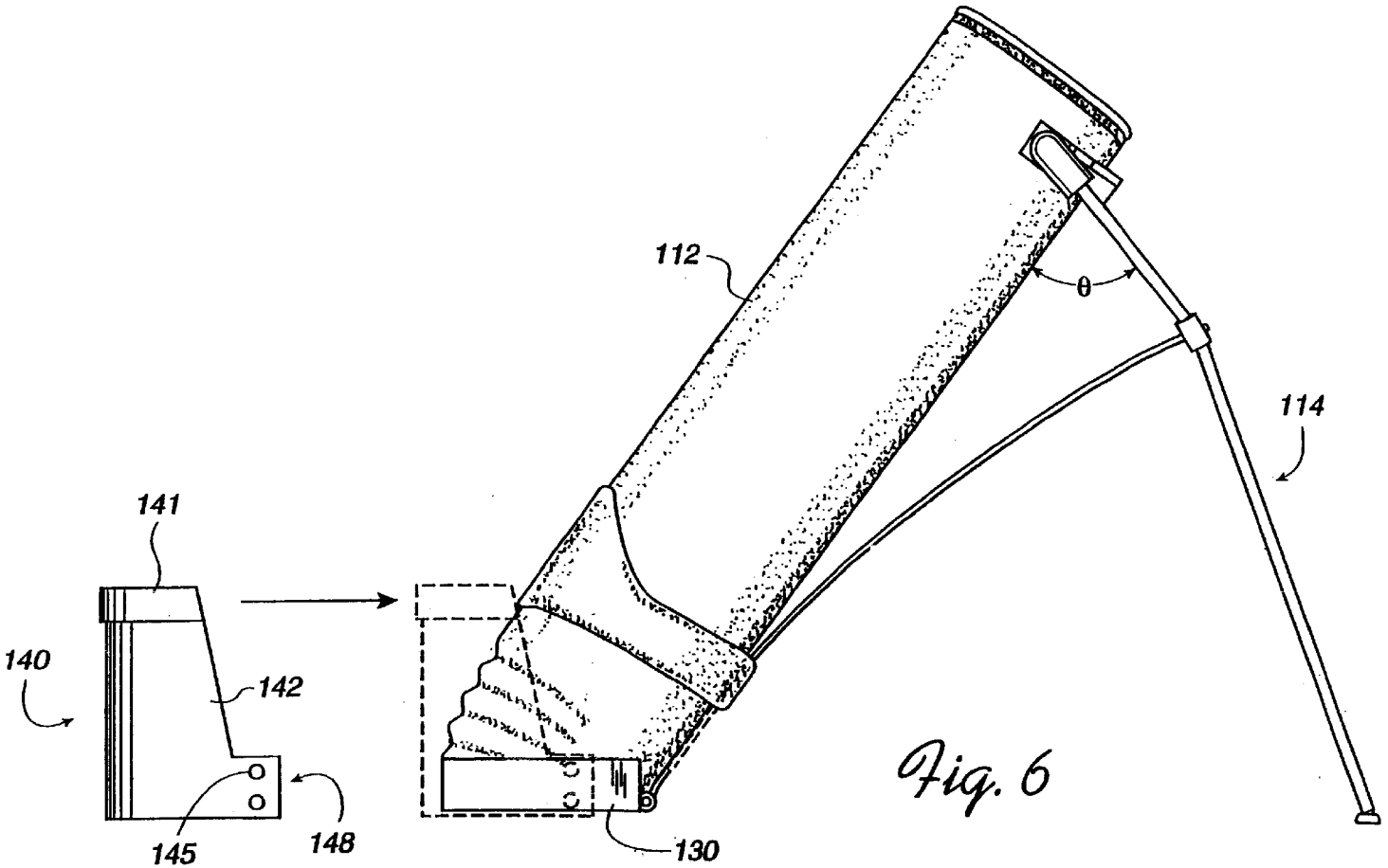
FIG. 6 is a lateral view of a second embodiment of the seat of the present invention showing a removable seat.
Figures 7A, 7B:
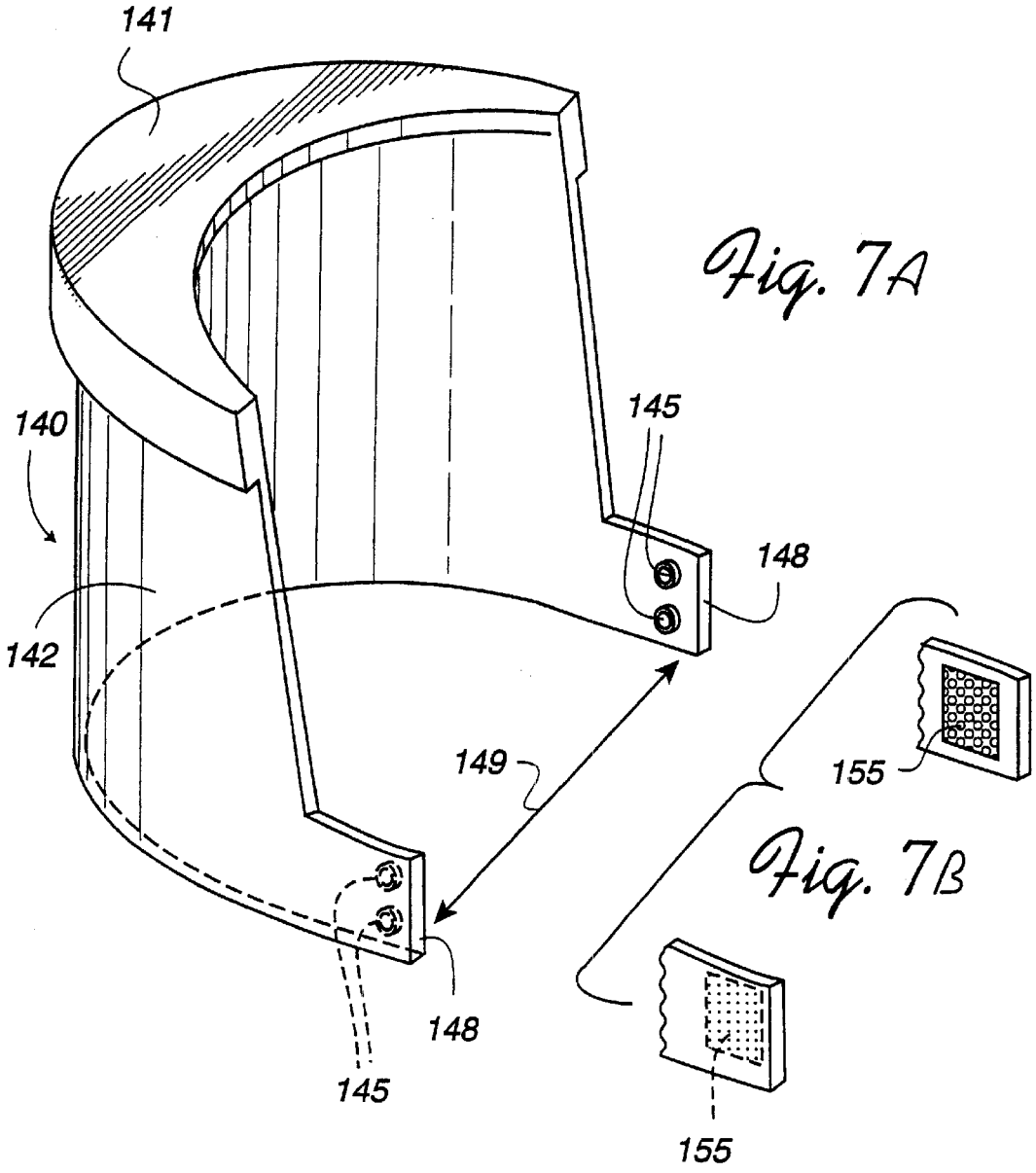
FIG. 7A is a detail showing the seat of the embodiment of FIG. 6.
FIG. 7B shows the embodiment of FIG. 7A with an alternate fastening device.

FIGS. 6, 7A and 7B show a second embodiment of the present invention where the seat member 140 is removably fastened to the lower region of the bag. Fastening devices include, without limitation, snaps 145 as seen in FIG. 7A, clasps, latches or VELCRO (TM) 155 (e.g., a hook and loop device) as best seen in FIG. 7B. Unlike the first embodiment, the seat of the second embodiment does not include a base member that surrounds and supports the bottom of the bag. Instead, the seat of the second embodiment wraps around the lower region of a bag that has its own base 130. The seat 140, which is substantially cylindrical in shape, has a rigid support member 142 and conforms to the shape of the bag and bag base 130. When the seat slidably surrounds the lower region of the bag, the fastening devices 145 on the arms 148 of the seat couple or are caused to couple to the base 130 of the bag. The top of the seat protrudes away from the bag and forms a surface 141 that will support a golfer. The seat 140 is made of a rigid material, such as plastic, and manufactured by a suitable process, such as injection molding, that will render a shape substantially similar to that shown in the drawings. The stand assembly 114 is substantially similar to that shown in the first embodiment.

The opening 149 defined by the arms 148 of the seat member 140 is slightly larger than the bag base 130 to firmly fit in a partial surrounding relation to the base.

Figure 8:
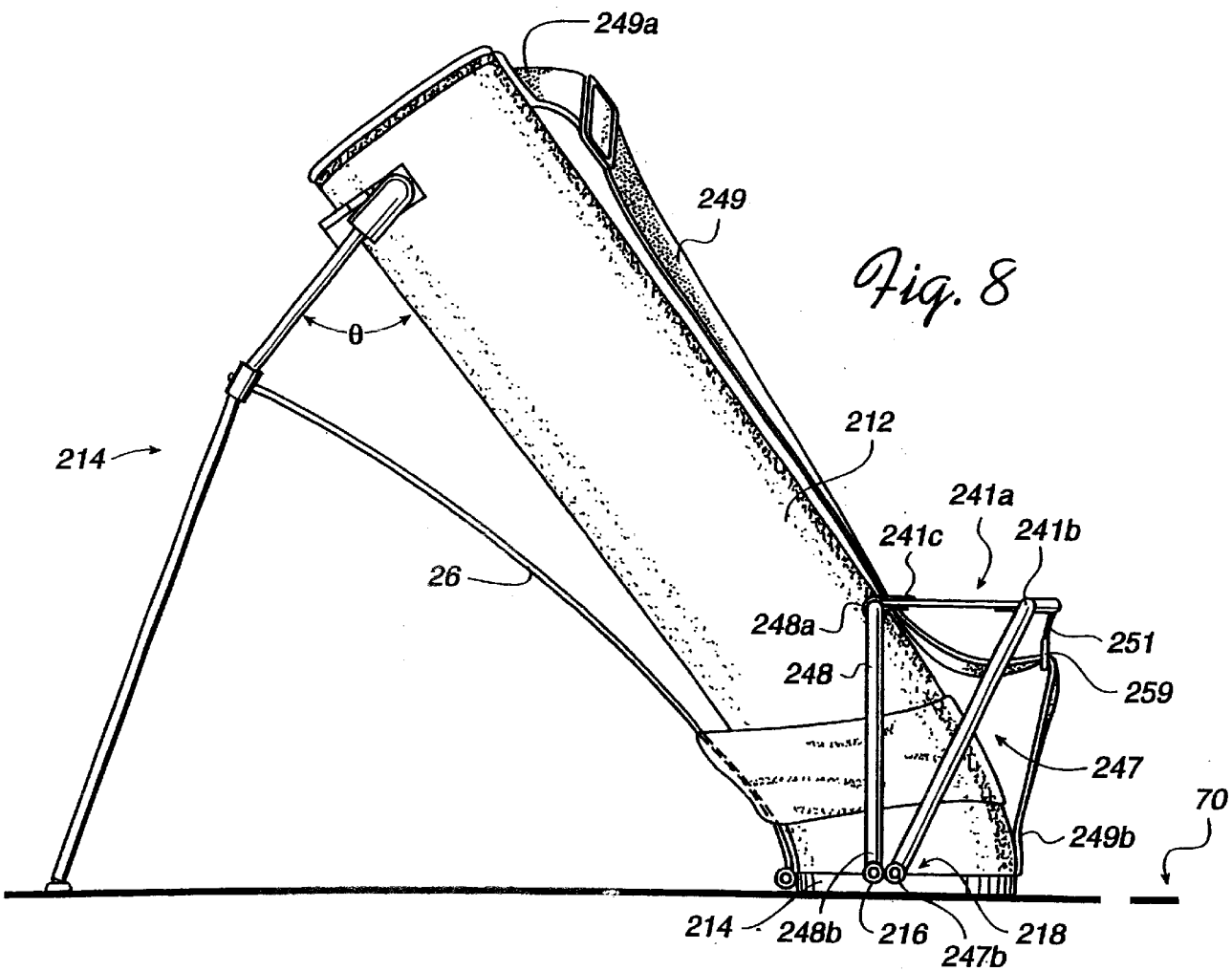
FIG. 8 is a lateral view of a third embodiment of the present invention showing an extendable and collapsible seat.
Figure 9:
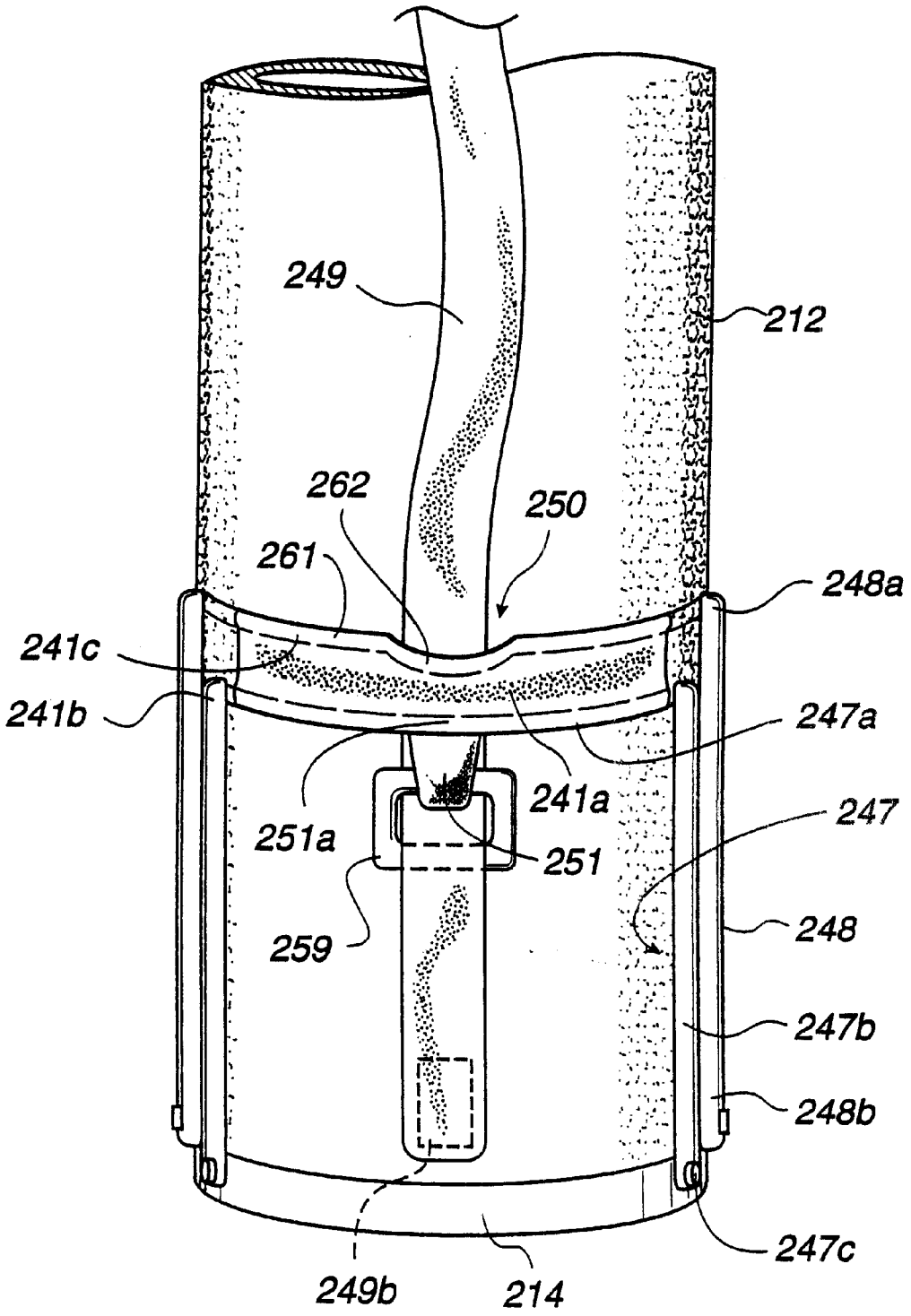
FIG. 9 is a partial front view of the lower region of the embodiment of FIG. 8.
Figure 10B:
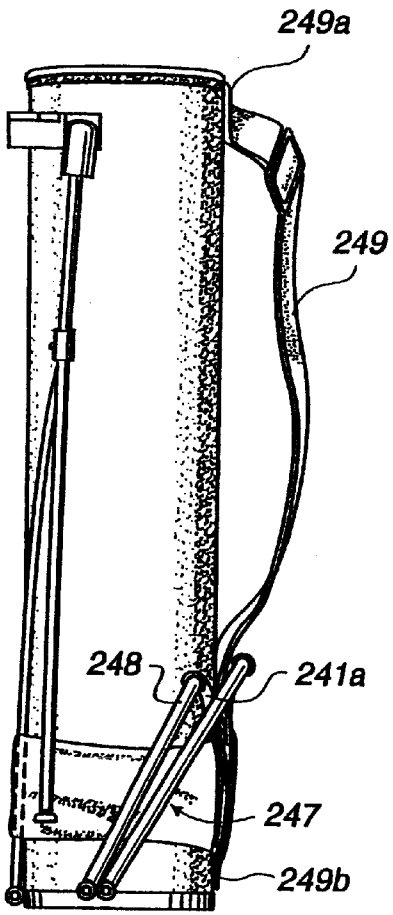
FIGS. 10A and 10B show the embodiment of FIG. 8 moving from an extended position in FIG. 10A to a collapsed position in FIG. 10B.

FIGS. 8–10B show a third embodiment of the seat member of the present invention. The third embodiment includes an extendable seating surface 241*a* that is preferably made of a flexible material known to one of ordinary skill in the art, for instance a sturdy fabric. The seating surface 241*a* is associated with the front surface of the lower region of the bag and lies substantially parallel to a supporting surface 70 on which the bag and the lower ends of the legs rest when the bag is in an extended position as shown in FIGS. 8 and 10A. The seating surface 241*a* can also assume a substantially collapsed position as shown in FIG. 10B where it lies against the front surface of the lower region of the bag. The seating surface 241*a* has a front end 241*b* and a back end 241*c*, the back end 241*c* associated with the front surface of the lower region of the bag. In some embodiments, the back end 241*c* is fastened to the front surface of the lower region of the bag, for instance by stitching.

The third embodiment with the extendable seating surface also includes a rigid support member 247 including a first crossbar 247*a* coupled at each end to a top end of each of two sidebars 247*b*. The two bottom ends 247*c* of the side bars are pivotally coupled to the side surface of the base member 214.

A preferred embodiment includes a plurality of supplemental support members 248, each coupled at a top end 248*a* to the back end of the seating surface and also to the bag. Preferably, the second cross bar 261 is affixed to the bag body 212. The bottom ends 248*b* of the supplemental support members are coupled to the base member 214 of the bag. The pivoting point 216 of the supplemental support members 248 is preferably placed behind the pivoting point 218 of the support member 247. Alternatively, both the supplemental support member 248 and the support member 247 may share the same pivoting point. Further alternatively, the back end of the seating surface 241*a* may be stitched directly onto the bag body 212 so that the tilting action for extending and collapsing the seating surface 241*a* may be carried out with the support member 247.

In the third embodiment of the present invention, the first cross bar 247*a* and the second cross bar 261 are contoured to the shape of the bag body 212. As a result, when the seat is not in use, it can be folded against the bag body 212 without substantially protruding parts. The second cross bar 261 preferably has an indent 262 for receiving a carrying strap 249.

Figure 10A:
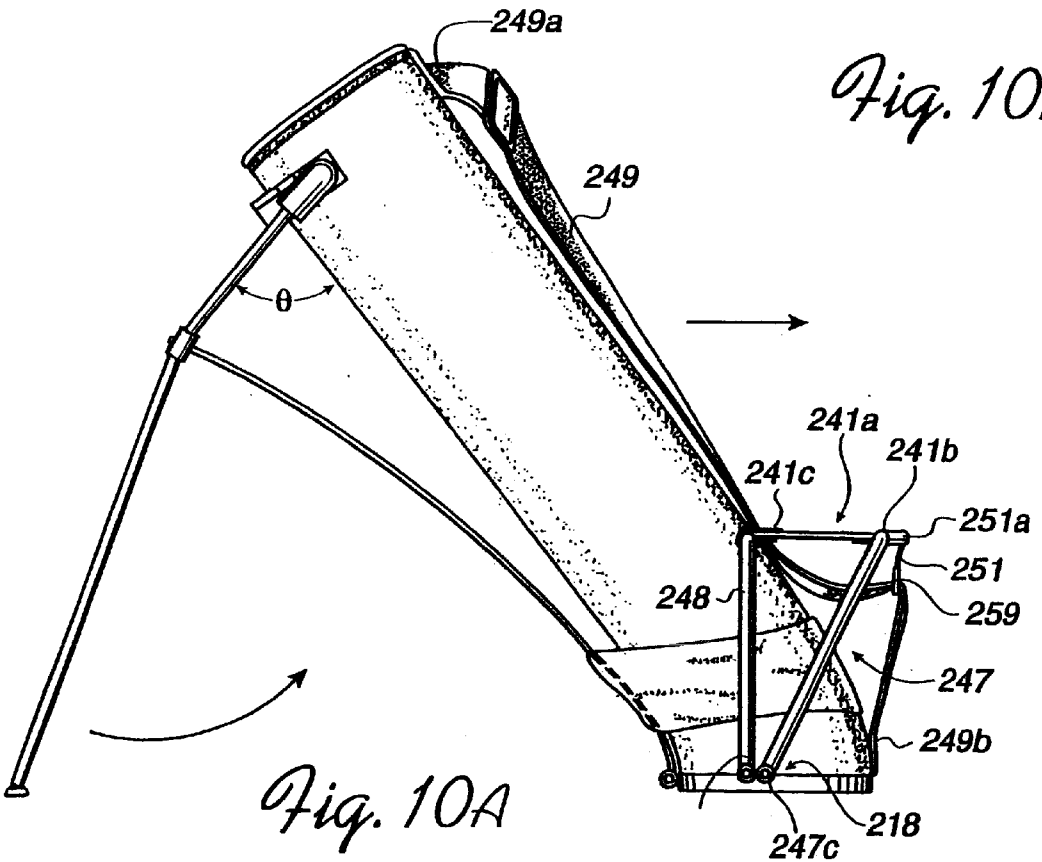

A preferred embodiment includes a carrying strap 249 that has a top end 249*a* coupled to the top front surface of the bag body and a bottom end 249*b* coupled to the bottom end of the front surface of the bag. The back end 241*c* of the extendable seating surface is fastened on each end to the front surface of the bag body, a gap 250 forming between the extendable seating surface and the lower region of the bag body between the fastening regions of the back end of the seating surface. The carrying strap 249 passes through the gap 250. Preferred embodiments include a seat strap 251 that has a first end 251*a* coupled to the front end of the seating surface. The second end of the seat strap has an opening 259 of sufficient size to slidably receive the carrying strap 249. The seat strap 251 is positioned between the seating surface and the bottom end of the bag. The carrying strap 249 passes through the opening 259 in the seat strap. The carrying strap 249 lies against the bag body as shown in FIG. 10A when the seating surface is in an extended position. Pulling the upper region of carrying strap 249 away from the bag body pulls the seat strap toward the front surface of the bag, pulling the planar surface into a collapsed position as shown in FIG. 10B. The third embodiment includes a support stand 214 that is substantially the same as that shown in the first embodiment.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag assembly comprising:

a body having a front surface, a back surface, a lower region and a bottom end, the body defining a longitudinal axis;

at least one leg pivotally connected to the back surface of the body and being able to pivot between a retracted position where the leg is disposed substantially longitudinally along the back surface of the body and an extended position where lower end of the leg is spaced apart from the body; and a seat member coupled to the lower region of the front surface of the bag body for supporting a weight of a golfer.

2. A golf bag assembly comprising a body having a front surface, a back surface, a lower region and a bottom end, the body defining a longitudinal axis;

at least one leg pivotally connected to the back surface of the body and being able to pivot between a retracted position where the leg is disposed substantially longitudinally along the back surface of the body and an extended position where lower end of the leg is spaced apart from the body; and a seat member coupled to the lower region of the front surface of the bag body, wherein the seat member comprises:

a seating surface associated with the front surface of the lower region of the bag, the seating surface lying substantially parallel to a supporting surface on which the bag and the lower end of the leg rest when the bag is in an extended position; and a support member which extends from and supports the seating surface.

3. The golf bag assembly of claim 2, wherein the support member further comprises a base member that surrounds and receives the bottom end of the bag and is coupled thereto.

4. The golf bag assembly of claim 2, wherein the seat member is removably coupled to the lower region of the bag body.

5. The golf bag assembly of claim 4, the seat member and the bag each further comprising aligned engagable fastening members, the seat removable from the body when the fastening members are disengaged.

6. The golf bag assembly of claim 2, wherein the seat member is removably coupled to the lower region of the bag body.

7. The golf bag assembly of claim 6, the seat member and the bag each further comprising aligned engagable fastening members, the seat removable from the body when the fastening members are disengaged.

8. The golf bag assembly of claim 7, wherein the support member has an inner and the bag has an outer surface, and wherein the fastening members each comprise opposite mate snaps, one coupled to the inner surface of the seat member and one coupled to a corresponding alignable location on the outer surface of the lower region of the bag.

9. A golf bag assembly comprising:

a body having a front surface, a back surface, a lower region and a bottom end, the body defining a longitudinal axis;

at least one leg pivotally connected to the back surface of the body pivoting between a retracted position where the leg is disposed substantially longitudinally along the back surface of the body and an extended position where lower end of the leg is spaced apart from the body; and a seat member coupled to the lower region of the front surface of the bag body, the seat comprising:

a collapsible seating surface associated with the front surface of the lower region of the bag; and a support member having a first cross bar coupled to the seating surface, wherein ends of the support member are pivotally connected to a base member at the bottom end of the body.

10. The golf bag assembly of claim 9, wherein the support member includes a first support extending from the first cross bar and pivotally connected to the base member and further includes a second support extending from a second cross bar, the second cross bar having an indent for receiving therethrough a carrying strap.

11. A seating apparatus for a golf bag having a body with a front surface, a back surface, a lower region and a bottom end, the body defining a longitudinal axis, wherein the golf bag has at least one leg pivotally connected to the back surface of the body and being able to pivot between a retracted position where the leg is disposed substantially longitudinally along the back surface of the body and an extended position where a lower end of the leg is spaced apart from the body, the seating apparatus comprising:

a seating surface for placing in the front surface of the golf bag, the seating surface lying substantially parallel to a support surface on which the golf bag rests when the leg is in the extended position;

a lower end for coupling to the lower region of the body of the golf bag; and a support member extending from the lower end to the seating surface.

12. The seating apparatus of claim 11, wherein the support member further comprises a base member for surrounding and receiving the bottom end of the bag and is coupled thereto.

13. A method of manufacturing a golf bag, comprising the steps of:

providing a golf bag having a body with a front surface, a back surface, a lower region and a bottom end, the body defining a longitudinal axis;

providing at least one leg pivotally connected to the back surface of the body and being able to pivot between a retracted position where the leg is disposed substantially longitudinally along the back surface of the body and an extended position where a lower end of the leg is spaced apart from the body; and attaching a seating apparatus to the front surface of the golf bag, wherein the seating apparatus includes a seating surface disposed in the front surface of the golf bag, the seating surface lying substantially parallel to a support surface on which the golf bag rests when the leg is in the extended position;

a lower end coupled to the lower region of the body of the golf bag; and a support member extending from the lower end to the seating surface.

14. The seating apparatus of claim 13, wherein the support member has a first cross bar coupled to the seating surface, wherein ends of the support member for pivotally connecting to a base member at the bottom end of the body.

15. A method for manufacturing a golf bag, comprising the steps of:

providing a golf bag having a body with a front surface, a back surface, a lower region and a bottom end, the body defining a longitudinal axis;

providing at least one leg pivotally connected to the back surface of the body and being able to pivot between a retracted position where the leg is disposed substantially longitudinally along the back surface of the body and an extended position where a lower end of the leg is spaced apart from the body; and attaching a seating apparatus to the front surface of the golf bag, wherein the seating apparatus includes a seating surface disposed in the front surface of the golf bag, the seating surface lying substantially parallel to a support surface on which the golf bag rests when the leg is in the extended position;

a lower end coupled to the lower region of the body of the golf bag; and a support member extending from the lower end to the seating surface.

16. The method of claim 15, wherein the support member further comprises a base member that surrounds and receives the bottom end of the bag and is coupled thereto.

17. The method of claim 16, wherein the support member is removably coupled to the lower region of the bag body.

18. The method of claim 17, wherein the lower end of the seat member includes fastening members for removably coupling to the lower region of the bag body.

19. The method of claim 18, wherein the fastening members are at least one of hook and loop apparatus and opposite mate snaps.

20. The seating apparatus of claim 18, wherein the seating surface is collapsible.

21. The seating apparatus of claim 20, wherein the support member has a first cross bar coupled to the seating surface, wherein ends of the support member are pivotally connected to the bottom end of the body.

22. The seating apparatus of claim 21, wherein the support member includes a first support extending from the first cross bar and pivotally connected to the body and further includes a second support extending from a second cross bar, the second cross bar having an indent for receiving therethrough a carrying strap.

23. The seating apparatus of claim 21, wherein the support member includes a first support extending from the first cross bar and pivotally connected to the base member and further includes a second support extending from a second cross bar, the second cross bar having and indent for receiving therethrough a carrying strap.

24. The seating apparatus of claim 20, wherein the support member has a first cross bar coupled to the seating surface, wherein ends of the support member are pivotally connected to a base member at the bottom end of the body.

25. The seating apparatus of claim 24, wherein the support member includes a first support extending from the first cross bar for pivotally connecting to the base member and further includes a second support extending from a second cross bar, the second cross bar having an indent for receiving therethrough a carrying strap.

* * * * *